US009082343B2

(12) United States Patent
Park

(10) Patent No.: US 9,082,343 B2
(45) Date of Patent: Jul. 14, 2015

(54) ORGANIC LIGHT-EMITTING DISPLAY APPARATUS AND METHOD OF PROVIDING POWER THEREIN

(75) Inventor: Sung-Cheon Park, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 355 days.

(21) Appl. No.: 13/197,054

(22) Filed: Aug. 3, 2011

(65) Prior Publication Data

US 2012/0032938 A1 Feb. 9, 2012

(30) Foreign Application Priority Data

Aug. 6, 2010 (KR) ..... 10-2010-0075991

(51) Int. Cl.
*G09G 3/32* (2006.01)

(52) U.S. Cl.
CPC ..... *G09G 3/3208* (2013.01); *G09G 2330/028* (2013.01); *G09G 2330/04* (2013.01); *G09G 2330/12* (2013.01)

(58) Field of Classification Search
USPC ..... 345/76–83, 204, 690; 315/169.3
See application file for complete search history.

(56) References Cited

U.S. PATENT DOCUMENTS

| | | | | |
|---|---|---|---|---|
| 5,224,010 | A | 6/1993 | Tran et al. | |
| 7,675,245 | B2 * | 3/2010 | Szczeszynski et al. | 315/291 |
| 8,487,924 | B2 * | 7/2013 | Jin et al. | 345/212 |
| 2007/0035533 | A1 * | 2/2007 | Kim | 345/204 |
| 2008/0111810 | A1 | 5/2008 | Park | |
| 2008/0143655 | A1 | 6/2008 | Ko | |
| 2008/0246702 | A1 | 10/2008 | Lee et al. | |
| 2009/0079713 | A1 * | 3/2009 | Nagashima | 345/204 |

FOREIGN PATENT DOCUMENTS

| | | | |
|---|---|---|---|
| CN | 101231818 | A | 7/2008 |
| EP | 1 783 536 | A1 | 5/2007 |
| EP | 1978506 | A2 | 10/2008 |
| JP | H 6-348220 | A | 12/1994 |
| JP | 2005-218190 | A | 8/2005 |
| KR | 10-2001-0009064 | A | 2/2001 |
| KR | 10 2005-0020253 | A | 3/2005 |
| KR | 10-2005-0051074 | A | 6/2005 |

(Continued)

OTHER PUBLICATIONS

Quad Voltage Up and Down Sequencer and Monitor with Programmable Timing AMD1186; Analog Devices; 2008-2009 (Jun. 2009); pp. 1-28; Analog Devices; U.S.A.

(Continued)

*Primary Examiner* — Charles V Hicks
*Assistant Examiner* — Jeffrey S Steinberg
(74) *Attorney, Agent, or Firm* — Lee & Morse, P.C.

(57) ABSTRACT

An organic light-emitting display apparatus and method of providing power in the organic light-emitting display apparatus. The organic light-emitting display apparatus including an organic light-emitting panel, a power supplying unit for supplying a first power voltage and a second power voltage to the organic light-emitting panel, and a driver integrated circuit comprising a short protection unit, wherein the short protection unit detects a short based on at least one of the first power voltage and the second power voltage and outputs an enable off signal that blocks the first power voltage and the second power voltage from being supplied to the power supplying unit.

20 Claims, 8 Drawing Sheets

(56) References Cited

FOREIGN PATENT DOCUMENTS

| | | | |
|---|---|---|---|
| KR | 10-2007-0032926 | A | 3/2007 |
| KR | 10-2008-0019197 | A | 3/2008 |
| KR | 10-0956162 | B1 | 5/2010 |

OTHER PUBLICATIONS

European Search Report in EP 11176855.2-1228, dated Dec. 6, 2011 (PARK).

Chinese Office action dated Aug. 5, 2014 for CN 201110166661.8 (PARK).

* cited by examiner

ORGANIC LIGHT-EMITTING DISPLAY APPARATUS AND METHOD OF PROVIDING POWER THEREIN

BACKGROUND

1. Field

Embodiments relate to an organic light-emitting display apparatus, and more particularly, to an organic light-emitting display apparatus including a short protective circuit for power voltage and a method of providing power in the organic light-emitting display apparatus.

2. Description of the Related Art

Organic light-emitting display apparatuses are used as display apparatuses such as portable information terminals including personal computers, mobile phones, PDAs, various information devices, etc. Also, various light emitting display apparatuses having lower weight and volume than those of cathode ray tubes have been developed. In particular, organic light-emitting display apparatuses having excellent light emission efficiency, brightness, and viewing angles and rapid response speeds have been highlighted.

An organic light-emitting display apparatus includes an organic light-emitting panel, a scan driver, and a source driver. The organic light-emitting panel includes pixels electrically connected to each other between scan lines and data lines that cross the scan lines. The scan driver drives the scan lines, and the source driver drives the data lines. The scan driver sequentially applies scan signals to the organic light-emitting panel through the scan lines and the source driver sequentially applies data signals to the organic light-emitting panel through the data lines. The organic light-emitting panel is electrically connected to the data lines and the scan lines, and thereby receives the data signals and the scan signals so that light is emitted.

SUMMARY

One or more embodiments may provide an organic light-emitting display apparatus which may reduce a possibility of a fire starting due to a short between power voltages in an organic light-emitting panel.

One or more embodiments may provide an organic light-emitting display apparatus including an organic light-emitting panel, a power supplying unit for supplying a first power voltage and a second power voltage to the organic light-emitting panel, and a driver integrated circuit including a short protection unit, wherein the short protection unit detects a short based on at least one of the first power voltage and the second power voltage and outputs an enable off signal that blocks the first power voltage and the second power voltage from being supplied to the power supplying unit.

The short protection unit may include a signal generating unit for generating a short detection starting signal that starts short detection based on the enable on signal that allows the power supplying unit to supply the first power voltage and the second power voltage to the organic light-emitting panel, a short-detecting unit for detecting the short and generating a short detection signal, and a signal controlling unit for outputting the enable off signal based on the enable on signal, the short detection starting signal, and the short detection signal.

The short detection starting signal may be generated after a predetermined time delay from the enable on signal.

The short-detecting unit may include a voltage distribution unit for distributing the first power voltage and outputting a detected voltage, and a comparing unit for comparing the detected voltage with a reference voltage and detecting a short.

The comparing unit may determine that there is a short when the detected voltage is less than the reference voltage and outputs the short detection signal.

The comparing unit may include an operational amplifier in which the reference voltage is input to a non-inverting input terminal thereof and the detected voltage is input to an inverting input terminal thereof.

The comparing unit may be activated based on the short detection starting signal.

The voltage distribution unit may include a first resistor connected between the first power voltage and the detected voltage, and a second resistor connected between the detected voltage and ground voltage.

The signal controlling unit may include a logic gate that logically operates the enable on signal, the short detection starting signal, and the short detection signal.

The short-detecting unit may include: a first short-detecting unit for detecting a short based on the first power voltage; and a second short-detecting unit for detecting a short based on the second power voltage.

The driver integrated circuit may output the enable off signal when the short occurs over a reference time.

The driver integrated circuit may be shut down at the same time as the output of the enable off signal or after a predetermined time delay.

One or more embodiments may provide a method of providing power in an organic light-emitting display apparatus including detecting a short in a driver integrated circuit based on at least one of a first power voltage and a second power voltage supplied from a power supplying unit to an organic light-emitting panel, and outputting an enable off signal to the power supplying unit when a short is detected, wherein the enable off signal blocks the first power voltage and the second power voltage being supplied from the driver integrated circuit.

Detecting the short may include generating a short detection starting signal that starts short detection based on the enable on signal that allows the power supplying unit to supply the first power voltage and the second power voltage to the organic light-emitting panel, and detecting the short and generating a short detection signal.

The short detection starting signal may be generated after a predetermined time delay from the enable on signal.

Generating of the short detection signal may include distributing the first power voltage and generating a detected voltage, comparing the detected voltage with a reference voltage after receiving the short detection starting signal, and generating the short detection signal when the reference voltage is less than the reference voltage.

Outputting of the enable off signal may include outputting the enable off signal when the short occurs over a reference time.

Outputting of the enable off signal may include outputting the enable off signal by logically operating the enable on signal, the short detection starting signal, and the short detection signal.

When a short is detected, the driver integrated circuit may be shut down at the same time as the output of the enable off signal or after a predetermined time delay.

Outputting the short detection signal may include outputting a first short detection signal when the first power voltage is less than first reference voltage, and outputting a second short detection signal when the second power voltage is greater than second reference voltage.

BRIEF DESCRIPTION OF THE DRAWINGS

The above and other features and advantages will become more apparent to those of ordinary skill in the art by describing in detail exemplary embodiments with reference to the attached drawings, in which.

DETAILED DESCRIPTION

Figure 1:
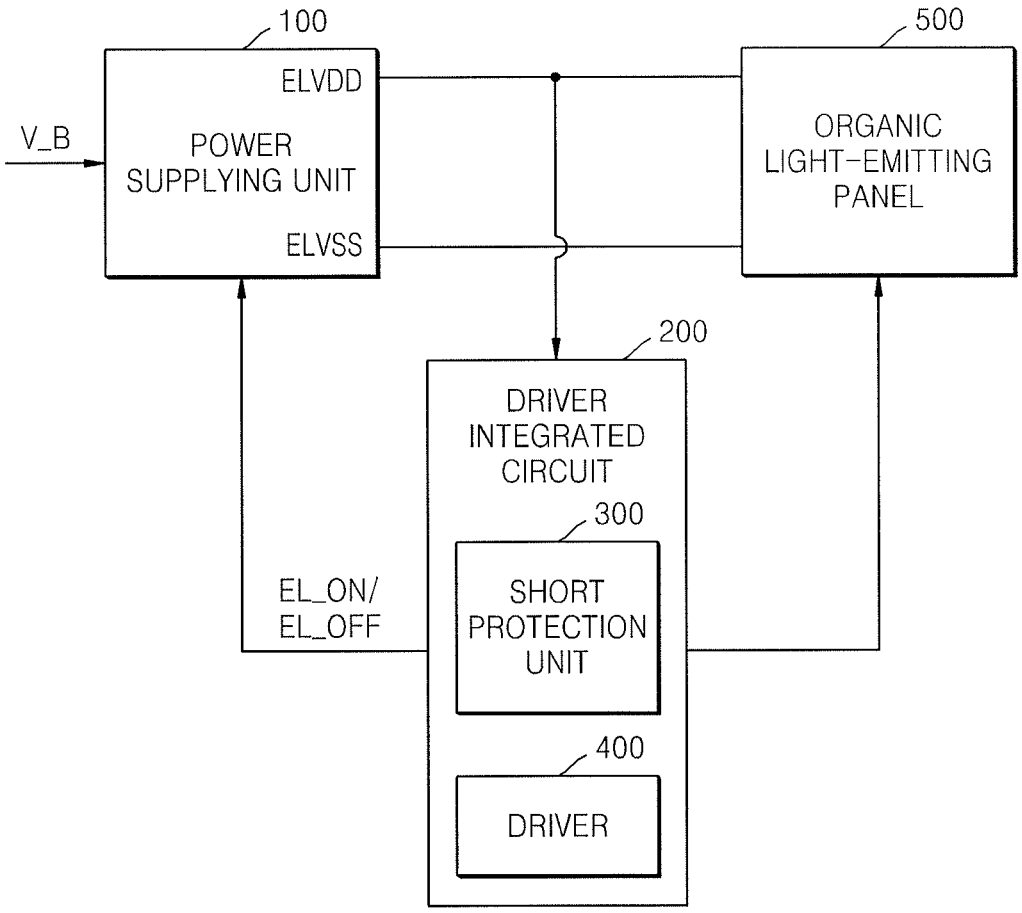
FIG. 1 illustrates a block diagram of an organic light-emitting display apparatus according to an exemplary embodiment.

Korean Patent Application No. 10-2010-0075991, filed on Aug. 6, 2010, in the Korean Intellectual Property Office, and entitled: "Organic Light-Emitting Display Apparatus and Method of Providing Power Therein," is incorporated by reference herein in its entirety.

Exemplary embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art. In the drawings, like reference numerals denote like elements. In the description, the detailed descriptions of well-known technologies and structures may be omitted so as not to hinder understanding.

FIG. 1 illustrates a block diagram of an organic light-emitting display apparatus according to an exemplary embodiment. Referring to FIG. 1, the organic light-emitting display apparatus includes a power supplying unit 100, a driver integrated circuit (IC) 200, and an organic light-emitting panel 500.

The power supplying unit 100 may receive an input voltage V_B from an external power unit such as a battery and may convert the input voltage V_B so as to generate a first power voltage ELVDD and a second power voltage ELVSS for a light-emitting device of the organic light-emitting panel 500 to emit light. The first power voltage ELVDD and the second power voltage ELVSS may be input to the organic light-emitting panel 500. The power supplying unit 100 may be a direct current-direct current (DC-DC) converter. The power supplying unit 100 may receive an enable on signal EL_ON from the driver IC 200 in a normal mode and may apply the first power voltage ELVDD and the second power voltage ELVSS to the organic light-emitting panel 500. When there is a short in the organic light-emitting panel 500, the power supplying unit 100 may receive an enable off signal EL_OFF from the driver IC 200 and may stop supplying the first power voltage ELVDD and the second power voltage ELVSS.

The driver 1C 200 may include a short protection unit 300 and a driver 400. The driver 400 may supply driving power to the organic light-emitting panel 500. The short protection unit 300 may sense at least one of the first power voltage ELVDD and the second power voltage ELVSS and may detect the existence of a short in the organic light-emitting panel 500. In FIG. 1, the first power voltage ELVDD may be sensed to detect the existence of a short. When power is turned on, the driver IC 200 may output the enable on signal EL_ON to the power supplying unit 100. Then, when a short is detected, the driver IC 200 may output the enable off signal EL_OFF to the power supplying unit 100.

If the organic light-emitting panel 500 is damaged, e.g., as a result of being dropped or an electric shock, a short may occur in a first power voltage ELVDD line and a second power voltage ELVSS line of the organic light-emitting panel 500. When a short occurs and the power supplying unit 100 continuously applies the first power voltage ELVDD and the second power voltage ELVSS to the organic light-emitting panel 500, excessive current may flow and/or fire may start when a short occurs.

Accordingly, in embodiments, when a short occurs, the driver IC 200 may shut down the power supplying unit 100 and may block supply of the first power voltage ELVDD and the second power voltage ELVSS to the organic light-emitting panel 500. The driver IC 200 may sense that the first power voltage ELVDD is reduced below a reference voltage. More particularly, e.g., the driver IC 200 may detect a short when it determines that the first power voltage ELVDD is below a reference voltage. When a short is detected, the driver IC 200 may output the enable off signal EL_OFF to the power supplying unit 100. Accordingly, the power supplying unit 100 may be shut down. When a short is detected, supply of the first power voltage ELVDD and the second power voltage ELVSS to the organic light-emitting panel 500 may be stopped.

The driver IC 200 may output the enable off signal EL_OFF and may shut down at that same time or after a predetermined time has passed. For example, the power supplying unit 100 may shut down after a corresponding frame is completed so that the driver IC 200 is in a sleep mode. Under such circumstances, as a driving voltage is not applied to the organic light-emitting panel 500, an abnormal screen may be prevented from being displayed. The time when the driver IC 200 enters to the sleep mode may be determined in consideration of stability of a display device.

The driver IC 200 that is shut down may normally operate again by being reset. When the driver IC 200 that is shut down normally operates after a reset, the driver IC 200 may perform a short detecting operation again.

The organic light-emitting panel 500 may receive the first power voltage ELVDD and the second power voltage ELVSS from the power supplying unit 100 and may supply the received first power voltage ELVDD and second power voltage ELVSS to each pixel. In each pixel, a driving current may flow from to the first power voltage ELVDD to the second power voltage ELVSS through a light-emitting device. The light-emitting device may emit light in correspondence to a data signal applied to the pixel.

Figure 2:
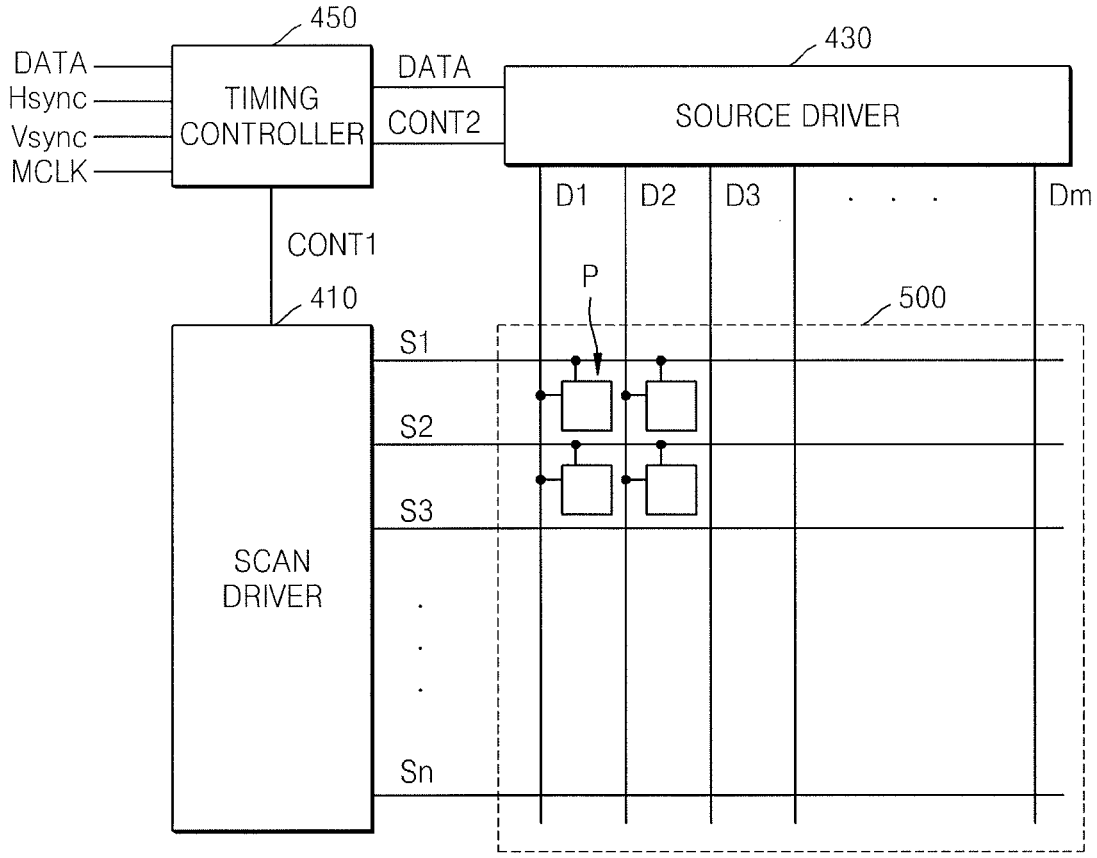
FIG. 2 illustrates a schematic diagram of an organic light-emitting panel of FIG. 1, according to an exemplary embodiment.

FIG. 2 schematically illustrates the organic light-emitting panel 500 of FIG. 1, according to an exemplary embodiment.

Referring to FIG. 2, the organic light-emitting panel 500 may include a plurality of scan lines S1-Sn, a plurality of data lines D1-Dm, and a plurality of pixels P. The plurality of scan lines S1-Sn may be spaced apart from each other by a predetermined interval, may be arranged in rows, and may each transmit a scan signal. The plurality of data lines D1-Dm may be spaced apart from each other by a predetermined interval, may be arranged in columns, and may each transmit a data signal. The plurality of scan lines S1-Sn and the plurality of data lines D1-Dm may be arranged in the form of matrix and one pixel P is formed at a cross point thereof.

In order to display a color, each pixel P may display its own color from among primary colors or may alternately display primary colors according to time so that a desired color may be recognized by spatial or temporal integration of the primary colors. Examples of the primary colors may include red R, green G, and blue B. When a color is displayed by a temporal integration, red R, green G, and blue B are alternately and temporarily displayed in one pixel so that only one color is displayed. When a color is displayed by a spatial integration, one color is displayed by a R pixel, a G pixel, and a B pixel. Thus, each of the R pixel, the G pixel, and the B pixel is referred to as a sub-pixel and three sub-pixels are referred to as one pixel. Also, when a color is displayed by a spatial integration, the R pixel, the G pixel, and the B pixel may be alternately arranged in a row direction or a column direction or the three pixels may be arranged to correspond to three apexes of a triangle.

The organic light-emitting panel 500 may be connected to a scan driver 410, a source driver 430, and a timing controller 450. The scan driver 410, the source driver 430, and the timing controller 450 may each be directly installed on the organic light-emitting panel 500 in the form of at least one integrated circuit chip or may be integrated on the organic light-emitting panel 500 along with the signal lines S1 through Sn, the data lines D1 through Dm, and a thin film transistor. Also, the scan driver 410, the source driver 430, and the timing controller 450 may each be integrated on the organic light-emitting panel 500 in a single chip.

The scan driver 410 may be connected to the scan lines S1 through Sn of the organic light-emitting panel 500 and may apply scan signals including a combination of a gate-on voltage and a gate-off voltage to the scan lines S1 through Sn. Here, the scan driver 410 may sequentially apply the scan signals to the plurality of scan lines S1 through Sn. When the scan signals include the gate-on voltage, a switching transistor connected to the corresponding scan line is turned on.

The source driver 430 may be connected to the data lines D1 through Dm of the organic light-emitting panel 500 and may apply data signals indicating gray scale to the data lines D1 through Dm. The source driver 430 may convert input image data DATA having gray scale input from the timing controller 450 into data signals in the form of voltage or current.

The timing controller 450 may receive the input image data DATA from an external graphic controller (not illustrated) and input control signals for controlling displaying of the input image data DATA. Examples of the input control signals may include a horizontal synchronization signal Hsync, a vertical synchronization signal Vsync, and a main clock signal MCLK. The timing controller 450 may transmit the input image data DATA to the source driver 430, may generate a scan control signal CONT1 and a data control signal CONT2, and may transmit the generated scan control signal CONT1 and data control signal CONT2 to the scan driver 410 and the source driver 430, respectively. The scan control signal CONT1 may include a scan starting signal SSP for indicating a scan start, and a plurality of clock signals SCLK. The data control signal CONT2 may include a horizontal synchronization starting signal STH indicating transmission of input image data for a pixel P in one row, and a clock signal.

Figure 3:
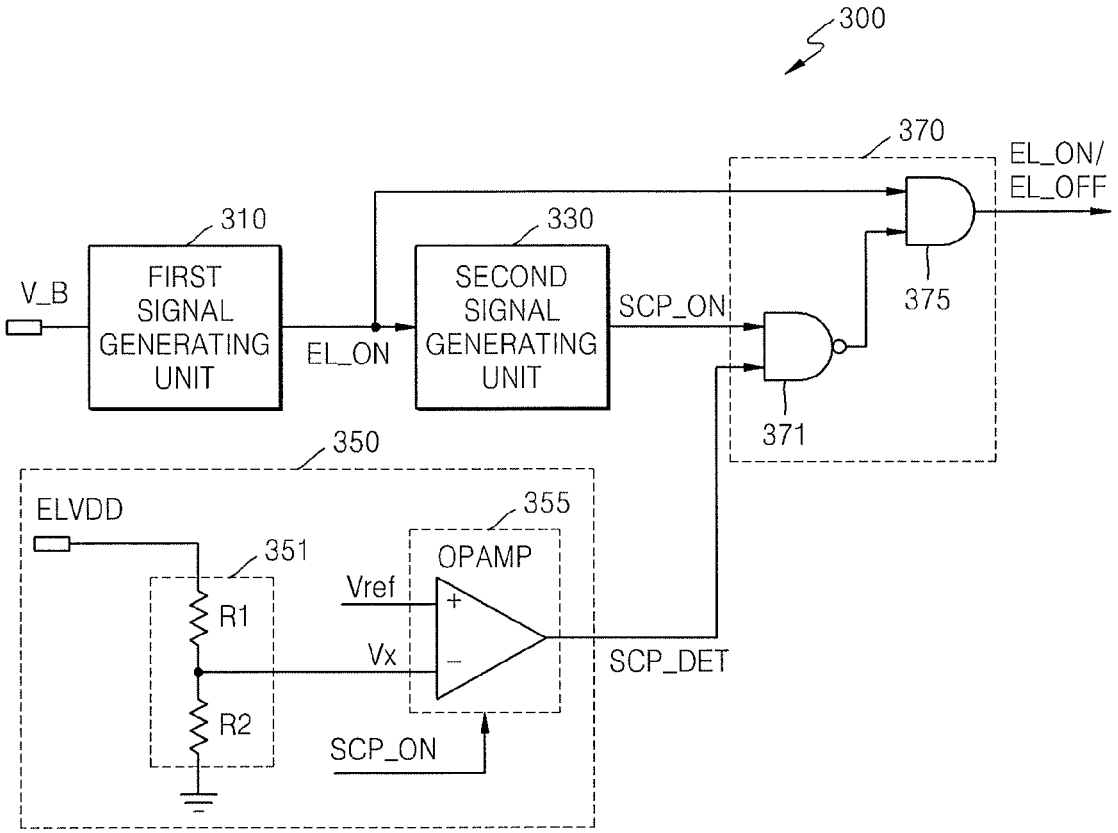
FIG. 3 illustrates a block diagram of a short protection unit of FIG. 1, according to an exemplary embodiment.

FIG. 3 illustrates a block diagram of the short protection unit 300 of FIG. 1, according to an exemplary embodiment.

Referring to FIG. 3, the short protection unit 300 may include a first signal generating unit 310, a second signal generating unit 330, a short-detecting unit 350, and a signal controlling unit 370.

The first signal generating unit 310 may generate the enable on signal EL_ON. The power supplying unit 100 supplies the first power voltage ELVDD and the second power voltage ELVSS to the organic light-emitting panel 500 due to the enable on signal EL_ON. When the first signal generating unit 310 receives the input voltage V_B from a battery, the first signal generating unit 310 generates the enable on signal EL_ON. The enable on signal EL_ON may be generated after a predetermined time from when the input voltage V_B is applied. The enable on signal EL_ON may be applied to the second signal generating unit 330 and the signal controlling unit 370.

According to the current exemplary embodiment, the first signal generating unit 310 is included in the short protection unit 300. However, the first signal generating unit 310 may be separate from the short protection unit 300 and/or may be included in the driver IC 200.

The second signal generating unit 330 may generate a short detection starting signal SCP_ON that starts short detection. The second signal generating unit 330 may generate the short detection starting signal SCP_ON after a predetermined time from when the enable on signal EL_ON is applied. In this regard, the power supplying unit 100 may stably output the first power voltage ELVDD and the second power voltage ELVSS by the enable on signal EL_ON and then a short may be detected. The short detection starting signal SCP_ON may be applied to the short-detecting unit 350 and the signal controlling unit 370.

When the short-detecting unit 350 receives the short detection starting signal SCP_ON, the short-detecting unit 350 may determine the existence of a short. The short-detecting unit 350 may sense the first power voltage ELVDD and may determine the existence of a short according to whether the first power voltage ELVDD is reduced below a predetermined voltage. When a short is detected, the short-detecting unit 350 may generate a short detection signal SCP_DET.

The short-detecting unit 350 may include a voltage distribution unit 351 and a comparing unit 355. The voltage distribution unit 351 may include a first resistor R1 and a second resistor R2. The first resistor R1 may be connected between the first power voltage ELVDD and a detected voltage Vx, and the second resistor R2 may be connected between the detected voltage V and a ground voltage. The comparing unit 355 may include an operational amplifier OPAMP. A reference voltage Vref may be input to a non-inverting input terminal of the operational amplifier OPAMP, and the detected voltage V may be input to an inverting input terminal of the operational amplifier OPAMP. The operational amplifier OPAMP may compare the reference voltage Vref with the detected voltage Vx. When the detected voltage Vx is less than the reference voltage Vref, the operational amplifier OPAMP may determine a short has occurred and generates the short detection signal SCP_DET.

The signal controlling unit 370 may receive the enable on signal EL_ON from the first signal generating unit 310. The signal controlling unit 370 may receive the short detection starting signal SCP_ON from the second signal generating unit 330. The signal controlling unit 370 may receive the short detection signal SCP_DET from the short-detecting unit 350. The signal controlling unit 370 may be formed of a 3in-1out logic gate by combining at least one from the group consisting of an AND gate, a NAND gate, an OR gate, a NOR gate, and XNOR gate. In FIG. 3, the signal controlling unit 370 includes a NAND gate 371 and an AND gate 375. The NAND gate 371 may receive the short detection starting signal SCP_ON and the short detection signal SCP_DET, may perform a NAND operation on the signals, and may output the result to the AND gate 375. The AND gate 375 performs an AND operation on the enable on signal EL_ON and the signal supplied from the NAND gate 371. As the result of operation, the enable on signal EL_ON or the enable off signal EL_OFF may be output. As an example, when the received signals are on signals, that is, in a high-level state, the AND gate 375 may output the enable off signal EL_OFF.

Figure 4A:
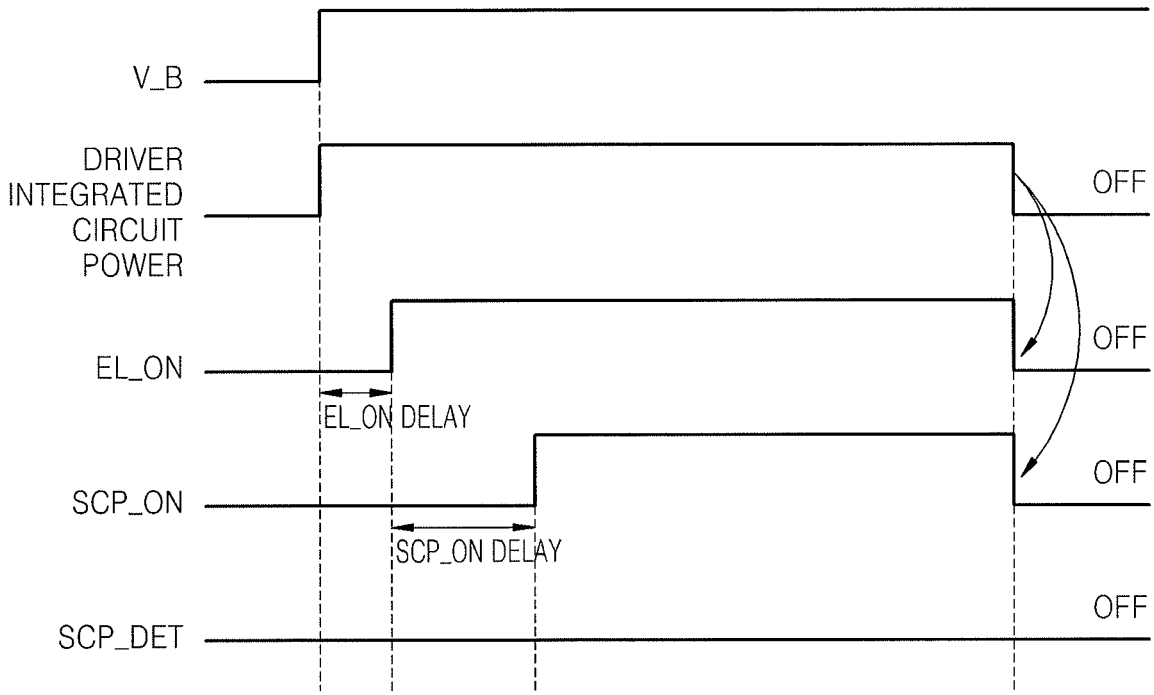
FIGS. 4A through 4C illustrate timing diagrams of an operation of a driver integrated circuit (IC), according to exemplary embodiments.

FIG. 4A illustrates a timing diagram illustrating an operation of the driver IC 200 in a normal mode without a short, according to an exemplary embodiment.

Referring to FIGS. 3 and 4A, the driver IC 200 may receive the input voltage V_B from a battery, and a mode of the driver IC 200 may converted from a sleep mode to a driving mode when power is turned on.

The short protection unit 300 may generate the enable on signal EL_ON after a predetermined time delay EL_ON_DELAY from when the input voltage V_B is applied. The enable on signal EL_ON may be output to the power supplying unit 100 according to the result of a logic operation of the signal controlling unit 370. Before the short detection starting signal SCP_ON is generated, only the enable on signal EL_ON may be generated, and the short detection starting signal SCP_ON and the short detection signal SCP_DET may be in an off-state. The signal controlling unit 370 may output the enable on signal EL_ON according to the result of a logic operation of the enable on signal EL_ON, the short detection starting signal SCP_ON being in an off-state, and the short detection signal SCP_DET. The power supplying unit 100 may receive the enable on signal EL_ON, may generate the first power voltage ELVDD and the second power voltage ELVSS based on the input voltage V_B, and may output the generated first power voltage ELVDD and second power voltage ELVSS to the organic light-emitting panel 500.

The short protection unit 300 may generate the enable on signal EL_ON and generates the short detection starting signal SCP_ON after a predetermined time delay SCP_ON_DELAY. For example, the short detection starting signal SCP_ON may be generated after the time delay SCP_ON_DELAY required to receive the enable on signal EL_ON by the power supplying unit 100 and may generate the first power voltage ELVDD and the second power voltage ELVSS.

The short protection unit 300 may start short detection via the short detection starting signal SCP_ON. When a short is not detected, the short detection signal SCP_DET may be in an off-state. Accordingly, the enable on signal EL_ON may be maintained in a high state according to the result of a logic operation of the enable on signal EL_ON in the signal controlling unit 370, the short detection starting signal SCP_ON, and the short detection signal SCP_DET in an off-state.

In addition, when power of the driver IC 200 is turned off, a mode thereof may be converted to a sleep mode, and the enable on signal EL_ON and the short detection starting signal SCP_ON may change to an off-state.

Figure 4B:
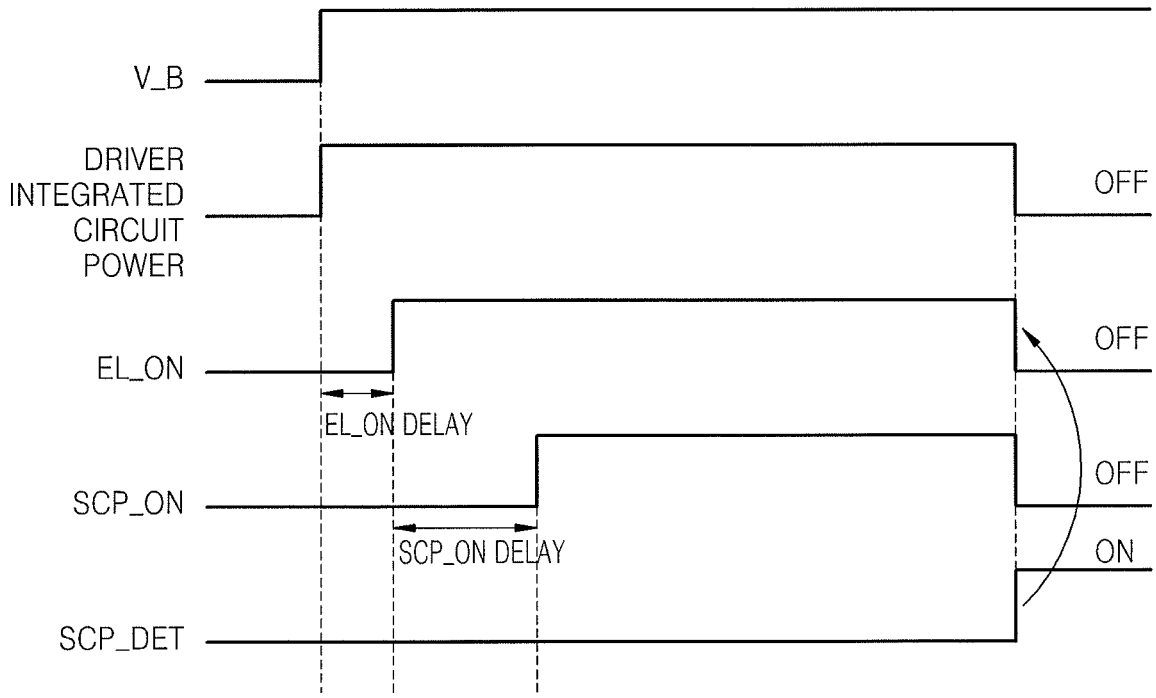

FIG. 4B illustrates a timing diagram of an exemplary operation of the driver IC 200 in a short mode, according to an exemplary embodiment.

Referring to FIGS. 3 and 4B, the driver IC 200 may receive the input voltage V_B from a battery and a mode of the driver IC 200 may be converted from a sleep mode to a driving mode when power is turned on.

The short protection unit 300 may generate the enable on signal EL_ON after a predetermined time delay EL_ON_DELAY from when the input voltage V_B is applied. The enable on signal EL_ON may be output to the power supplying unit 100 according to the result of a logic operation of the signal controlling unit 370. Before the short detection starting signal SCP_ON is generated, only the enable on signal EL_ON is generated, and the short detection starting signal SCP_ON and the short detection signal SCP_DET are in an off-state. The signal controlling unit 370 may output the enable on signal EL_ON according to the result of a logic operation of the enable on signal EL_ON, the short detection starting signal SCP_ON being in an off-state, and the short detection signal SCP_DET. The power supplying unit 100 may receive the enable on signal EL_ON, may generate the first power voltage ELVDD and the second power voltage ELVSS based on the input voltage V_B, and may output the generated first power voltage ELVDD and second power voltage ELVSS to the organic light-emitting panel 500.

The short protection unit 300 may generate the enable on signal EL_ON and generates the short detection starting signal SCP_ON after a predetermined time delay SCP_ON_DELAY. For example, the short detection starting signal SCP_ON may be generated after the time delay SCP_ON_DELAY required to receive the enable on signal EL_ON by the power supplying unit 100 and may generate the first power voltage ELVDD and the second power voltage ELVSS.

The short protection unit 300 may start short detection by the short detection starting signal SCP_ON. When a short is detected, the short detection signal SCP_DET may be generated. The signal controlling unit 370 may output the enable off signal EL_OFF to the power supplying unit 100 according to the result of a logic operation of the enable on signal EL_ON, the short detection starting signal SCP_ON, and the short detection signal SCP_DET, each of which are in an on-state.

The driver IC 200 may be shut down after the enable off signal EL_OFF is output so that power is turned off and a mode thereof may be converted to a sleep mode. Accordingly, the short detection starting signal SCP_ON may be in an off-state. Conversion to the sleep mode may be accomplished at the same time as the output of the enable off signal EL_OFF or after the predetermined time delay, for example, at the time of completing a corresponding frame.

In addition, the power supplying unit 100 may receive the enable off signal EL_OFF and may stop output of the first power voltage ELVDD and the second power voltage ELVSS.

Figure 4C:
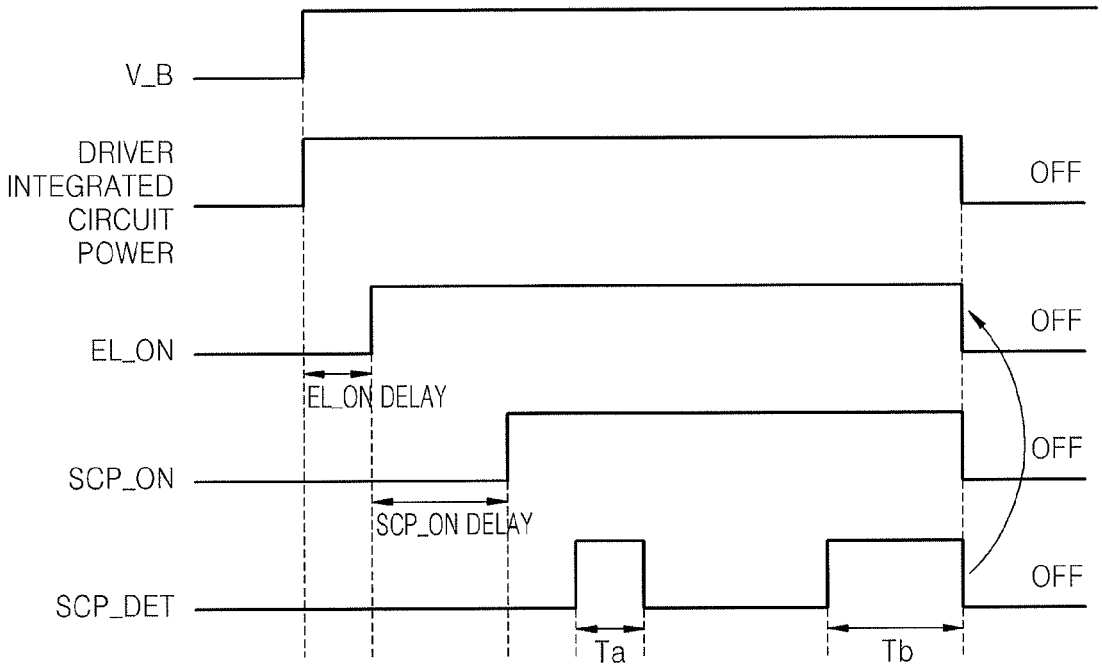

FIG. 4C illustrates a timing diagram of an exemplary operation of the driver IC 200 in a short mode, according to an exemplary embodiment.

Referring to FIG. 4C, the driver IC 200 may receive the input voltage V_B from a battery and a mode of the driver IC 200 may be converted from a sleep mode to a driving mode when power is turned on.

The short protection unit 300 generates the enable on signal EL_ON after a predetermined time delay EL_ON_DELAY from when the input voltage V_B is applied. The enable on signal EL_ON is output to the power supplying unit 100 according to the result of a logic operation of the signal controlling unit 370. Before the short detection starting signal SCP_ON is generated, only the enable on signal EL_ON is generated, and the short detection starting signal SCP_ON and the short detection signal SCP_DET are in an off-state. The signal controlling unit 370 outputs the enable on signal EL_ON according to the result of a logic operation of the enable on signal EL_ON, the short detection starting signal SCP_ON in an off-state, and the short detection signal SCP_DET. The power supplying unit 100 receives the enable on signal EL_ON, generates the first power voltage ELVDD and the second power voltage ELVSS based on the input voltage V_B, and outputs the generated first power voltage ELVDD and second power voltage ELVSS to the organic light emitting panel 500.

The short protection unit 300 generates the enable on signal EL_ON and generates the short detection starting signal SCP_ON after predetermined time delay SCP_ON_DELAY. For example, the short detection starting signal SCP_ON is generated after the time delay SCP_ON_DELAY required to receive the enable on signal EL_ON by the power supplying unit 100 and generate the first power voltage ELVDD and the second power voltage ELVSS.

The short protection unit 300 starts short detection by the short detection starting signal SCP_ON. When a short is not detected, the short detection signal SCP_DET is generated. The short protection unit 300 controls output of the enable off signal EL_OFF according to the duration of the short detection signal SCP_DET. For example, when the duration Ta of the short detection signal SCP_DET is less than a reference time, the short protection unit 300 maintains the enable on signal EL_ON in an on-state and when the duration Tb of the short detection signal SCP_DET is greater than the reference time, the short protection unit 300 outputs the enable off signal EL_OFF.

The driver IC 200 is shut down after the enable off signal EL_OFF is output so that power is turned off and a mode thereof is converted to a sleep mode. Accordingly, the short detection starting signal SCP_ON is in an off-state. Conversion to the sleep mode may be accomplished at the same time as the output of the enable off signal EL_OFF or after the predetermined time delay. In addition, the power supplying unit 100 receives the enable off signal EL_OFF and stops output of the first power voltage ELVDD and the second power voltage ELVSS.

Figure 5:
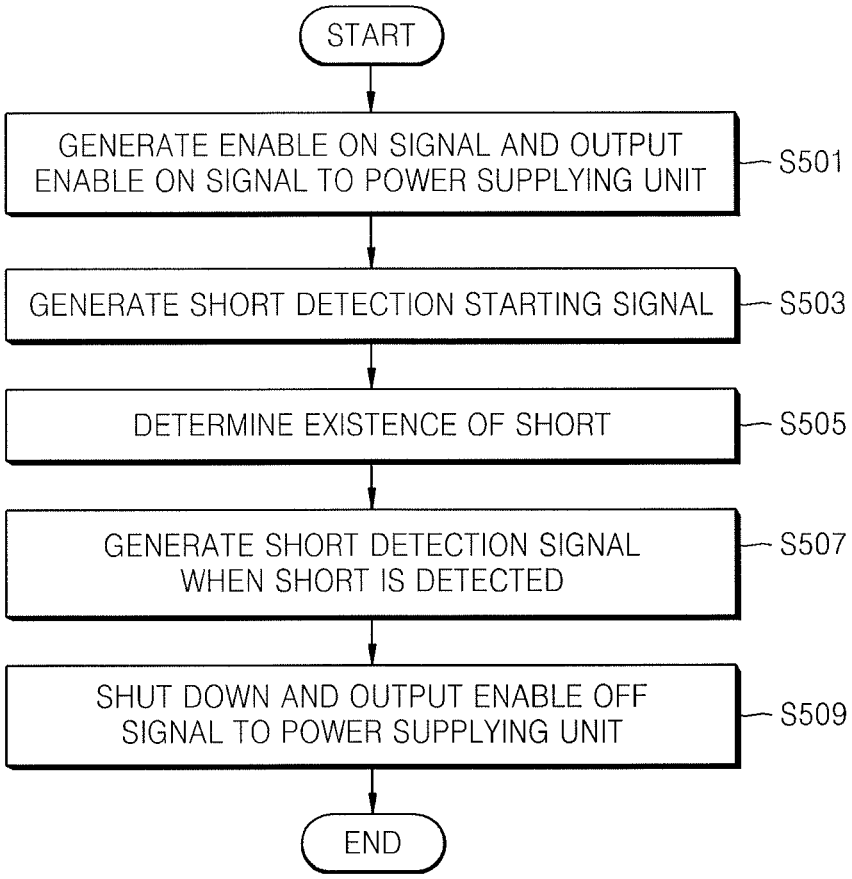
FIG. 5 illustrates a flowchart of a method of providing power in an organic light-emitting display apparatus, according to an exemplary embodiment.

FIG. 5 is a flowchart illustrating a method of providing power in an organic light-emitting display apparatus, according to an exemplary embodiment.

Referring to FIG. 5, a driver integrated circuit, which receives an input voltage from a battery, generates an enable on signal and outputs the generated enable on signal to a power supplying unit, in operation S501. The enable on signal allows the power supplying unit to apply a first power voltage and a second power voltage to an organic light-emitting panel. Here, in an initial stage of driving, a short detection starting signal and a short detection signal are in on off-state so that the enable on signal is output to the power supplying unit according to the result of a logic operation of the enable on signal, the short detection starting signal in an off-state, and the short detection signal in an off-state. The power supplying unit receives the enable on signal, generates the first power voltage and the second power voltage, and outputs the generated first power voltage and second power voltage.

A driver IC generates a short detection starting signal that starts short detection based on the enable on signal, in operation S503. The short detection starting signal is generated after predetermined time from the enable on signal, that is, time delay that is requested to receive the enable on signal by the power supplying unit and to complete boosting to the first power voltage and the second power voltage based on the input voltage.

The driver IC determines the existence of a short, in operation S505. The driver integrated circuit distributes the first power voltage to compare a detected voltage with a reference voltage. When the reference voltage is less than the reference voltage, it is determined that a short has occurred. The existence of a short is determined by the short detection starting signal.

When a short is detected, the driver IC generates the short detection signal, in operation S507, and outputs the enable off signal to the power supplying unit, in operation S509. The first power voltage and the second power voltage may be prevented from being supplied from the power supplying unit to the organic light-emitting panel by the enable off signal. Here, since the enable signal, the short detection starting signal, and the short detection signal are in on-state, the enable off signal is generated and output according to the result of a logic operation of the signals. The driver IC is shut down at the same time as the output of the enable off signal or after a predetermined time delay.

When power supply to the organic light-emitting panel is blocked by the enable off signal, an excessive current is blocked and the possibility of a fire occurrence is reduced when a short occurs in the organic light-emitting panel.

The driver IC that is shut down operates again by being reset and repeatedly performs short detection.

Figure 6:
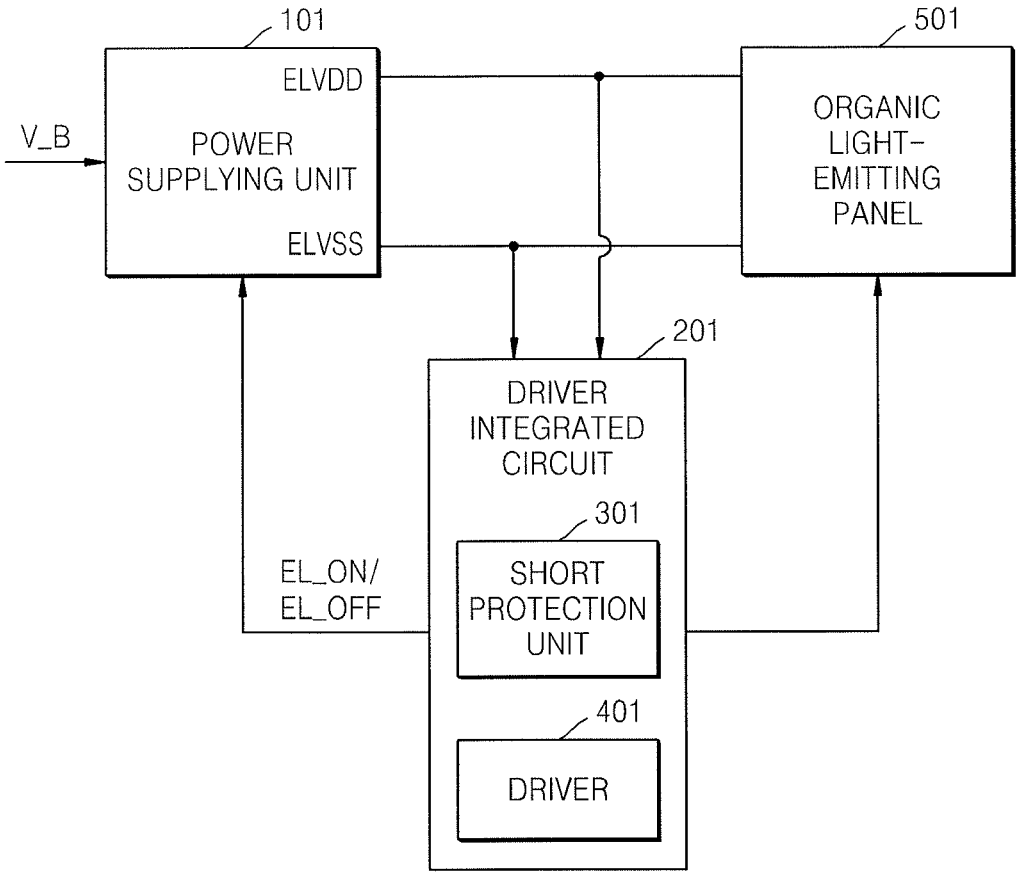
FIG. 6 illustrates a block diagram of an organic light-emitting display apparatus, according to another exemplary embodiment.
Figure 7:
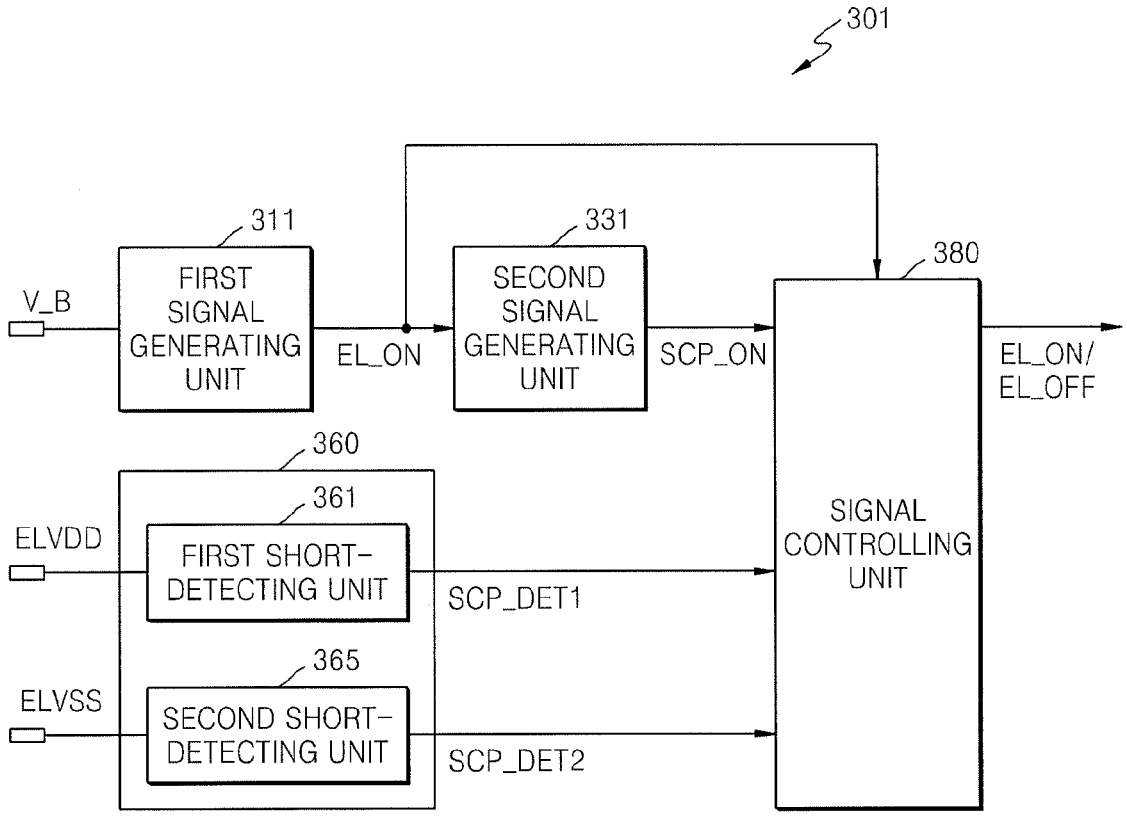
FIG. 7 illustrates a block diagram of a short protection unit of FIG. 6.

FIG. 6 illustrates a block diagram of an organic light-emitting display apparatus, according to an exemplary embodiment and FIG. 7 illustrates a block diagram of a short protection unit 301 of FIG. 6.

Referring to FIG. 6, the organic light-emitting display apparatus according to the current exemplary embodiment includes a power supplying unit 101, a driver IC 201, and an organic light-emitting panel 501. The driver IC 201 includes a short protection unit 301 and a driver 401.

The driver IC 201 of FIGS. 6 and 7 is different from the driver IC 200 of FIG. 1 in that the driver IC 201 senses both the first power voltage ELVDD and the second power voltage ELVSS and detects the existence of a short of the organic light-emitting panel 501. Hereinafter, detailed descriptions that are the same as those with respect to FIG. 1 will not be repeated. Timing diagrams illustrating an operation of the driver IC 201 may be also illustrated in FIGS. 4A through 4C.

When a short occurs in a first power voltage ELVDD line and a second power voltage ELVSS line of the organic light-emitting panel 501, the first power voltage ELVDD supplied to the first power voltage ELVDD line is reduced and the second power voltage ELVSS supplied to the second power voltage ELVSS line is increased. Accordingly, the short protection unit 301 senses that the first power voltage ELVDD is reduced below a first reference voltage and the second power voltage ELVSS is increased above a second reference voltage, thereby detecting a short.

Referring to FIG. 7, the short protection unit 301 may include a first signal generating unit 311, a second signal generating unit 331, a short-detecting unit 360, and a signal controlling unit 380. The short-detecting unit 360 may include a first short-detecting unit 361 and a second short-detecting unit 365. The first signal generating unit 311, which receives the input voltage V_B from a battery, generates the enable on signal EL_ON. The enable on signal EL_ON may be generated after a predetermined time delay from when the input voltage V_B is applied. The enable on signal EL_ON may be supplied to the second signal generating unit 331 and the signal controlling unit 380. As a result of a logic operation of the signal controlling unit 380, the enable on signal EL_ON may be output to the power supplying unit 101. The power supplying unit 101 may receive the enable on signal EL_ON, may generate the first power voltage ELVDD and the second power voltage ELVSS, and may output the generated first power voltage ELVDD and second power voltage ELVSS to the organic light-emitting panel 501.

The second signal generating unit 331 may generate the short detection starting signal SCP_ON that starts short detection after a predetermined time delay from the enable on signal EL_ON. The short detection starting signal SCP_ON may be supplied to the short-detecting unit 360 and the signal controlling unit 380. When the short-detecting unit 360 receives the short detection starting signal SCP_ON, the short-detecting unit 360 may determine the existence of a short. The first short-detecting unit 361 may sense the first power voltage ELVDD and may determine there is a short when the power voltage ELVDD is less than the first reference voltage. When it is determined there is a short, the first short-detecting unit 361 may generate a first short detection signal SCP_DET1. The second short-detecting unit 365 may sense the second power voltage ELVSS and may determine there is a short when the second power voltage ELVSS is greater than the second reference voltage. When it is determined there is a short, the second short-detecting unit 365 may generate a second short detection signal SCP_DET2.

The signal controlling unit 380 may receive the enable on signal EL_ON from the first signal generating unit 311, may receive the short detection starting signal SCP_ON from the second signal generating unit 331, and may receive the first and second short detection signals SCP_DET1 and SCP_DET2 from the short-detecting unit 360. The signal controlling unit 380 may perform an AND operation on the received signals. Since the signals received in the signal controlling unit 380 are in on-state (high-level state), the enable off signal EL_OFF may output as a result of the operation.

The driver IC 201 may be shut down after the enable off signal EL_OFF is output so that power is turned off and a mode thereof is converted to a sleep mode. Conversion to the sleep mode may be accomplished at the same time as the output of the enable off signal EL_OFF or after the predetermined time delay. The power supplying unit 101 may receive the enable off signal EL_OFF and may be shut down so that output of the first power voltage ELVDD and the second power voltage ELVSS is blocked.

The driver IC 201 that is shut down may operate again by being reset and repeatedly performs short detection.

In one or more embodiments, the organic light-emitting display apparatus may include a short detection function in the driver IC and may shut down the driver integrated circuit and the power supplying unit when a short occurs. Accordingly, one or more embodiments may reduce and/or prevent a fire due to a short.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An organic light-emitting display apparatus, comprising:

an organic light-emitting panel;

a power supply to generate and supply a first power voltage and a second power voltage to the organic light-emitting panel; and a driver integrated circuit including a short protection circuit, wherein the short protection circuit is to detect a short of the organic light-emitting panel based on at least one of the first power voltage or the second power voltage and to output an enable off signal, and wherein the power supply is to shut down in response to the enable off signal, the enable off signal to be generated by logically operating an enable on signal, a short detection starting signal, and a short detection signal, the enable off signal to be output to the power supply according to the logic operation of the enable on signal, the short detection starting signal, and the short detection signal, each of the enable on signal, the short detection starting signal, and the short detection signal being an on-state signal, and to block the first power voltage and the second power voltage from being supplied from the power supply to the organic light-emitting panel.

2. The apparatus as claimed in claim 1, wherein the short protection circuit comprises:

a signal generator to generate the enable on signal and the short detection starting signal, the enable on signal allowing the power supply to supply the first and second power voltages to the organic light-emitting panel, and the short detection starting signal starting short detection based on the enable on signal;

a short detector to detect the short and generate a short detection signal; and a signal controller to receive the enable on signal and the short detection starting signal from the signal generator and the short detection signal from the short detector, and to output the enable off signal, instead of the enable on signal, based on the enable on signal, the short detection starting signal, and the short detection signal, when the short is detected.

3. The apparatus as claimed in claim 2, wherein the short detection starting signal is generated after a predetermined time delay from the enable on signal.

4. The apparatus as claimed in claim 2, wherein an output of the short detector is independent of an output of the signal generator, the short detector comprises:

a voltage distributor to distribute the first power voltage and output a detected voltage; and a comparator to compare the detected voltage with a reference voltage and detect a short.

5. The apparatus as claimed in claim 4, wherein the comparator is to determine that there is a short when the detected voltage is less than the reference voltage and output the short detection signal.

6. The apparatus as claimed in claim 4, wherein the comparator comprises an operational amplifier in which the reference voltage is input to a non-inverting input terminal thereof and the detected voltage is input to an inverting input terminal thereof.

7. The apparatus as claimed in claim 4, wherein the comparator is activated based on the short detection starting signal.

8. The apparatus as claimed in claim 4, wherein the voltage distributor comprises:

a first resistor connected between the first power voltage and the detected voltage; and a second resistor connected between the detected voltage and ground voltage.

9. The apparatus as claimed in claim 2, wherein the signal controller comprises:

three inputs, the enable on signal and the short detection starting signal output from the signal generator and the short detection signal output from the short detector being connected to the three inputs; and a logic gate receiving signals from the three inputs, the logic gate to logically operate the enable on signal, the short detection starting signal, and the short detection signal.

10. The apparatus as claimed in claim 2, wherein the short detector comprises:

a first short detector to detect a short based on the first power voltage; and a second short detector to detect a short based on the second power voltage.

11. The apparatus as claimed in claim 1, wherein the driver integrated circuit is to output an enable on signal during operation of the organic light-emitting panel, and to output the enable off signal only when the short occurs over a reference time.

12. The apparatus as claimed in claim 1, wherein the driver integrated circuit is shut down at a same time as the output of the enable off signal or after a predetermined time delay.

13. A method of providing power in an organic light-emitting display apparatus, the method comprising:

detecting a short of the organic light-emitting panel in a driver integrated circuit based on at least one of a first power voltage or a second power voltage generated by a power supply and supplied from the power supply to an organic light-emitting panel; and outputting an enable off signal to the power supply when a short is detected, wherein the enable off signal blocks the first power voltage and the second power voltage being supplied from the driver integrated circuit to the organic light-emitting panel, and wherein the enable off signal shuts down the power supply, the enable off signal being generated by logically operating an enable on signal, a short detection starting signal, and a short detection signal, the enable off signal is to be output to the power supply according to the logic operation of the enable on signal, the short detection starting signal, and the short detection signal, each of the enable on signal, the short detection starting signal, and the short detection signal being an on-state signal.

14. The method as claimed in claim 13, wherein detecting the short comprises:

generating the short detection starting signal that starts short detection based on the enable on signal that allows the power supply to supply the first power voltage and the second power voltage to the organic light-emitting panel; and detecting the short and generating the short detection signal.

15. The method as claimed in claim 14, wherein the short detection starting signal is generated after a predetermined time delay from the enable on signal.

16. The method as claimed in claim 14, wherein generating the short detection signal comprises:

distributing the first power voltage and generating a detected voltage;

comparing the detected voltage with a reference voltage after receiving the short detection starting signal; and generating the short detection signal when the reference voltage is less than the reference voltage.

17. The method as claimed in claim 14, wherein outputting the enable off signal comprises:

outputting the enable off signal by logically operating the enable on signal, the short detection starting signal, and the short detection signal.

18. The method as claimed in claim 13, wherein outputting the enable off signal includes outputting the enable off signal when the short occurs over a reference time.

19. The method as claimed in claim 13, wherein when a short is detected, the driver integrated circuit is shut down at a same time as the output of the enable off signal or after a predetermined time delay.

20. The method as claimed in claim 14, wherein outputting the short detection signal comprises:

outputting a first short detection signal when the first power voltage is less than first reference voltage; and outputting a second short detection signal when the second power voltage is greater than second reference voltage.

* * * * *